US008409405B2

(12) United States Patent
Kim et al.

(10) Patent No.: US 8,409,405 B2
(45) Date of Patent: Apr. 2, 2013

(54) DEVICE AND METHOD FOR DOSING OR SHUTTING OFF PRIMARY COMBUSTION AIR IN THE PRIMARY HEATING ROOM OF HORIZONTAL COKE-OVEN CHAMBERS

(75) Inventors: Ronald Kim, Essen (DE); Alfred Mertens, Essen (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 0 days.

(21) Appl. No.: 13/255,422

(22) PCT Filed: Feb. 13, 2010

(86) PCT No.: PCT/EP2010/000896

§ 371 (c)(1),
(2), (4) Date: Sep. 8, 2011

(87) PCT Pub. No.: WO2010/102707

PCT Pub. Date: Sep. 16, 2010

(65) Prior Publication Data

US 2011/0315538 A1 Dec. 29, 2011

(30) Foreign Application Priority Data

Mar. 11, 2009 (DE) ..... 10 2009 012 264

(51) Int. Cl.
*C10B 9/00* (2006.01)
*C10B 15/02* (2006.01)
*C10B 21/10* (2006.01)

(52) U.S. Cl. ..... 201/27; 202/135; 202/151; 202/242; 202/245

(58) Field of Classification Search ..... 202/135, 202/151, 242, 244, 245, 250, 251; 201/27; 110/175, 176, 177; 251/122, 124, 318, 319
See application file for complete search history.

(56) References Cited

U.S. PATENT DOCUMENTS

| | | | | |
|---|---|---|---|---|
| 1,058,550 | A * | 4/1913 | Christie | 202/244 |
| 1,646,213 | A * | 10/1927 | Otis | 110/176 |
| 4,124,450 | A * | 11/1978 | MacDonald | 201/15 |
| 4,475,989 | A * | 10/1984 | Cain et al. | 202/251 |
| 6,187,148 | B1 | 2/2001 | Sturgulewski | |
| 2009/0152092 | A1 | 6/2009 | Kim et al. | |
| 2010/0025217 | A1 | 2/2010 | Schuecker et al. | |

FOREIGN PATENT DOCUMENTS

| | | | |
|---|---|---|---|
| CN | 1358822 | A | 7/2002 |
| DE | 102005015301 | A1 | 10/2006 |
| GB | 384092 | | 12/1932 |
| WO | 2006128612 | A1 | 12/2006 |
| WO | 2007057076 | A1 | 5/2007 |

OTHER PUBLICATIONS

International Search Report for PCT/EP2010/000896, English translation attached to original completed by the European Patent Office on Jun. 21, 2010. All together 6 Pages.

* cited by examiner

*Primary Examiner* — Jill Warden
*Assistant Examiner* — Joye L Woodard
(74) *Attorney, Agent, or Firm* — Brooks Kushman P.C.

(57) ABSTRACT

Dosed proportioning and cutoff of combustion air into the primary heating space of a horizontal coke oven is provided by apertures in the ceiling of the coke oven chamber, the apertures covered with a withdrawable cover device which controls the amount of air admitted, manually or in an automatic mode. By way of this device, ventilation of a coke oven chamber with primary air can be so controlled that primary air is introduced in an exactly dosed manner and, depending on its place of installation, exactly distributed into the primary heating space of a coke oven chamber.

20 Claims, 9 Drawing Sheets

DEVICE AND METHOD FOR DOSING OR SHUTTING OFF PRIMARY COMBUSTION AIR IN THE PRIMARY HEATING ROOM OF HORIZONTAL COKE-OVEN CHAMBERS

CROSS-REFERENCE TO RELATED APPLICATION

This application is the U.S. national phase of PCT Appln. No. PCT/EP2010/000896 filed Feb. 13, 2010 which claims priority to German application DE 2009 012 264.8 filed Mar. 11, 2009, the disclosure of which is incorporated in its entirety by reference herein.

BACKGROUND OF THE INVENTION

1. Field of the Invention

The invention relates to a device for dosed proportioning and cutoff of air supply devices feeding primary combustion air into the primary heating space of a coke oven chamber, the device being configured as a cover that can be stage-wise moved away from the air supply device so as to be able to exactly regulate the quantity of air streaming in. The number of stages may range from two stages to an indefinite number of stages so as to be able to regulate the entering stream of air in an arbitrarily fine manner. At the same time, this device also serves to cover the air supply device against weather impacts. The device distinguishes itself from prior art in technology in that it is situated outside the coke oven chamber on the air supply device, thus being easily accessible. Owing to the arrangement of this device, the dosed proportioning can be easily controlled and even be automated. The present invention also relates to a method for dosed proportioning of primary combustion air in a primary heating space of a coke oven chamber with the inventive device.

2. Description of the Related Art

Coking gas evolving on coal carbonization possesses a remarkable calorific value. To achieve a uniform distribution of coking heat generated in non-conventional coke oven chambers by combustion of coking gas, the coking gas is burnt in two steps. The evolving coking gas is initially conducted into a gas space located above the coke cake within the coke oven chamber where it is burnt with a sub-stoichiometric quantity of air. This air is called primary air or primary combustion air. The gas space above the coke cake is frequently called the "primary heating space." Partly burnt coking gas from the primary heating space is then passed via so-called "downcomer" channels into a "secondary heating space" where the coking gas is completely burnt. Thereby, the coke cake is also heated from below, thus achieving uniform heating of the coke cake from all sides. This leads to an improved and—above all—uniform quality of coke produced.

Carbonization of coal is often accomplished in coke ovens of the "Non-Recovery" or "Heat-Recovery" type which completely burn the coking gases evolving on coal carbonization and which utilize the heat of combustion from coking gases to heat the coal during the coke making process. With the "Heat-Recovery" type, the heat from burnt coking gas utilized to heat the coal cake is additionally exploited by a steam generator to generate energy, for example by means of a turbine installed further downstream. Coke ovens are typically utilized in configurations of several coke oven chambers arranged one behind the other, with consecutively arranged configurations of coke oven chambers of the "Non-Recovery" or "Heat-Recovery" type being called coke oven banks, and consecutively arranged configurations of coke oven chambers of the conventional type being called coke oven batteries.

A controlled combustion of coking gas in two steps calls for a precisely dosed supply of air both into the primary combustion space and into the secondary combustion space of a coking chamber. Devices known from prior art technology, however, frequently are of a very simple design and configuration so that a precisely dosed proportioning is impossible or they are so arranged that a distribution of combustion air can only be accomplished at a few or hardly accessible positions of a coke oven chamber. For the supply of secondary combustion air, a dosed proportioning of air supply in general is simpler, because the supply is not accomplished directly into the secondary combustion space, but via so-called secondary air soles arranged beneath the secondary combustion heating space and connected via the vertical channels to the actual secondary heating space.

WO 2006/128612 A1 describes a device for supplying primary combustion air into a coking chamber of a "Non-Recovery" or "Heat-Recovery" type coke oven. By way of this device, spatially uneven ventilation of the primary heating space of the coking chamber and uneven heat distribution in the coking chamber are prevented. By way of this device, primary air is admitted at a plurality or multitude of positions in the top ceiling of the coke oven chamber so that the admittance of primary air is exactly rated and variably controlled throughout the duration of the coking time. The device prevents immediate reaction of aspirated combustion air as it enters into the oven and limits combustion only to the entry area of primary air. The control of air admittance is accomplished by a control element not described here more closely.

U.S. Pat. No. 6,187,148 B1 describes a valve as a device for regulating a pressure setoff between primary heating space and secondary heating space or secondary air soles of a "Non-Recovery" or "Heat-Recovery" type coke oven which is utilized to establish a pressure setoff between primary heating space and secondary heating space of a coke oven chamber. Since a negative pressure prevails in the coke oven chamber especially at the beginning of the coking process as the cold coal cake is pressed in, the admittance of primary air which in the afore-mentioned teaching is accomplished through apertures in the coke oven chamber door and in flaps arranged there above, is only poorly controllable. For this reason, the invention provides for valves in the "downcomer" channels which cater for a pressure setoff between the primary heating space and secondary heating space of a coke oven chamber. If required, the valves can also be utilized for admitting secondary combustion air into the secondary heating space. A control of the admittance of primary combustion air is not described. The valves are easy to handle, because they are accommodated in the coke oven chamber sides averted from the door and because they are equipped with a revolving tube serving as shutoff device. A revolving tube, however, tends to get stuck at prevailing high temperatures and therefore it is susceptible to repairs. Likewise, the space demand for such a device is quite substantial.

CN 1358822 A describes a coke oven which essentially consists of a furnace body, a coke-oven chamber main wall, a furnace bottom, a furnace door with an adapted furnace door opening, a coal-charging machine, a coke-pushing machine, a coke-receiving device with quenching device and a component repair machine with iron tools. By adapting the arched furnace top, a primary-air regulating device, a secondary-air regulating equipment, upward and downward furnace wall holding devices, double-coupled air holes and fourfold-coupled furnace bottom arches, sandwich-type air feed devices and a bottom-based door support structure it is possible to raise the coke quality with varying feed coal types while further reducing the coke cost and ensuring good heat recovery. The teaching describes a flap for primary-air apertures on the ceiling of coke-oven chambers, the movement and operation mechanism of which, also in dependence of the carbonization process, is not disclosed in more detail.

DE 102005015301 A1 describes a method for the production of coke in a coke-oven chamber of a "Heat-Recovery" or "Non-Recovery" type coke oven, according to which the coke-oven chamber is filled with a layer of coal, the coal is heated, and volatile coal components degas from the coal, these volatile coal components partially oxidize directly above the coal layer, a combustion system is arranged beneath the coke-oven chamber and used for the combustion of not yet combusted volatile coal components as well as the gases generated in the partial oxidation, the coke-oven chamber contains side walls being provided with channels, these channels connecting the upper, coke-free part of the coke-oven chamber on the gas side with the combustion system arranged below the coke-oven chamber, the volatile coal components partially oxidize above the coal layer are conveyed via the channels to the combustion systems arranged beneath the coke-oven chamber, both the coke-oven chamber and the combustion system are equipped with devices for the restricted admittance of air, the combustion of the volatile coal components by means of air being at first accomplished only incompletely as partial oxidation in both the coke-oven chamber above the coal layer and also in the combustion system located below, and the complete combustion is accomplished later in a separate final combustion system which is arranged outside both the coke-oven chamber and the combustion system located beneath the coke-oven chamber. The teaching discloses adjustable air inlets on the ceiling of the coke-oven chamber, the detailed design of which, however, is not described.

WO 2007057076 A1 describes an aeration device for "Non-Recovery" type coke ovens, with the aeration device consisting of at least one opening which passes through the wall or through internals such as, for example, the oven door and connects the oven interior with the outer atmosphere surrounding the oven and can be wholly or partly closed by means of a closure element. In this case two or more of these closure elements are coupled by means of at least one mechanical connecting element such that the connecting element is fastened directly or via a lever to the closure elements, and each connecting element is connected to at least one central actuating element in such a manner that the closure elements can be moved, with the respective openings allowing closure, complete opening or setting to any intermediate position. The openings for the feed of primary air into the coke-oven chambers are provided in the coke-oven chamber doors so that the primary air enters the coke-oven chamber only in the surrounding of the coke-oven chamber doors. The adjustment is typically accomplished by a cover plate or screw spindles, by which precise adjustment is problematic under certain operating conditions and rain showers pose a problem.

Therefore, it would be of substantial benefit to avail of a simple device by means of which primary combustion air is conducted through the top ceiling of a coke oven chamber, with it being possible for this device to be comprised of a simple tube, shut-off by another device or controlled in a dosed manner in terms of its gas flow rate. Conducting it through the top ceiling is much simpler and requires less space. Moreover, mounting the control device outside the coke oven chamber and outside the actual air supply device would be much simpler and easier to service.

SUMMARY OF THE INVENTION

Now, therefore, it is an object of the present invention to furnish a device that allows for a dosed proportioning of primary combustion air into the primary heating space of a coke oven chamber, said dosed proportioning to be accomplished by means of a device that is mounted onto non-controlled air supply devices and shutting-off the air supply device as well as dosing or regulating it in terms of gas flow rate. The device for dosed proportioning is mountable on a single air supply device so as to allow for both an individual and multiple mounting of this device. Moreover, the device allows for both a stage-wise and infinite control and regulation. Finally, it is possible to regulate the device for dosed proportioning and cutoff both manually and by means of a motor-driven actuator so as to allow for its automation, if required. The inventive device is further expected to prevent the entry of water in the case of falling rain.

These and other objects are obtained by providing a device configured as a cover that can be put onto the device for air supply. This device configured as a lid provides dosed proportioning by being lifted off from the air feeder, which can be accomplished both by taking the device off vertically and by unfolding it laterally away. By way of this procedure, the device is easy to mount and operate and also requires only little maintenance. Owing to the external attachment, the device is also easily installable into existing coke oven chambers with air feeders through the coke oven chamber top ceiling. Lift-off can be accomplished by introduction of snap-in stoppers both in at least two stages and—in absence of these stoppers—by articulated joints providing sufficient retention by counter-weights in infinite graduation, or in other words, take off lift-off can be accomplished infinitely.

DETAILED DESCRIPTION OF THE PREFERRED EMBODIMENTS

Figure 1:
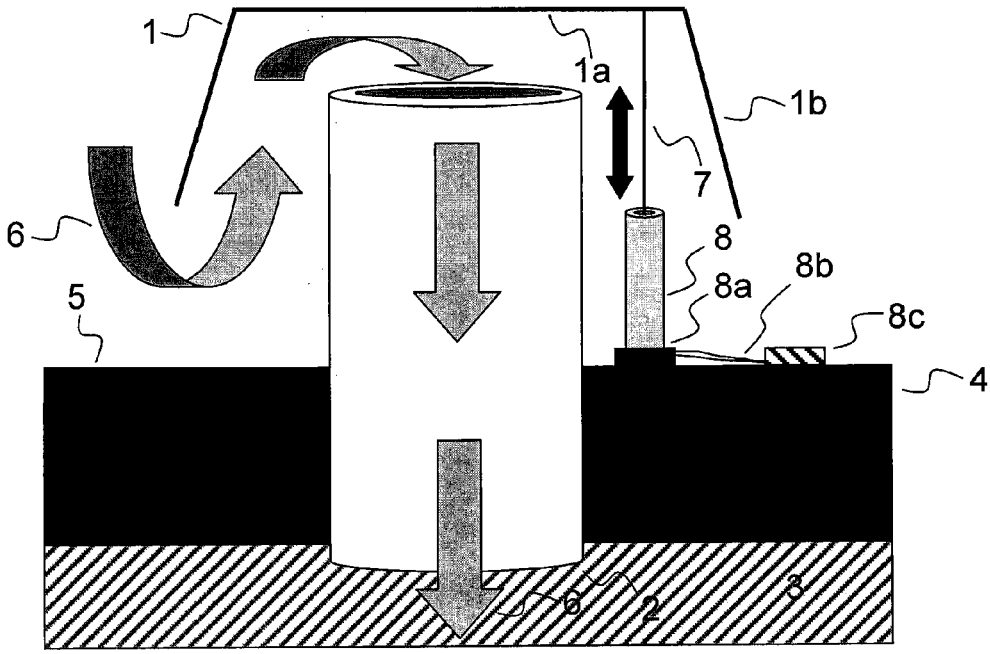
FIG. 1 illustrates one embodiment of a primary combustion air supply dosed proportioning and cutoff device of the invention.

The actual device is configured as a cover and can be shaped like an inverted cup, for example. In other words, it may be a plate that is provided with a downwardly molded collar-shaped circumference. In a further embodiment, the device may also be a hollow cone comprised of a downwardly open side and thus covering the air supply device with the tip in upward direction as if it were a hat. In a yet further embodiment, the dosed proportioning device may be comprised of a massive cone which is moved in with the tip in a downward direction into the air supply device, thus shutting it off gradually.

A simple and infinite or gradual dosed proportioning of primary combustion air into a coke oven chamber is feasible in this manner. The device can be mounted on a single air supply device or on several air supply devices. The invention possesses the benefit in that the interior of the coke oven chamber wall is protected from weather impacts. Particularly in tropical regions, heavy rain showers occur quite frequently and regularly, thus posing a major problem to the operation of horizontal coke oven chambers. In the event of heavy rain falls, water again and again penetrates through the primary air feeders into the coke oven chamber, which may substantially disturb the oven operation and which may destroy the oven brickwork. By way of the inventive device, penetration of water during rain falls is reliably prevented.

Claim is particularly laid to a coke oven chamber of a coke oven bank or coke oven battery, having a device for dosed proportioning or cutoff of primary combustion air into the primary heating space of horizontal coke oven chambers, wherein at least one aperture for supply of primary combustion air is arranged in the top ceiling of at least one coke oven chamber of a coke oven bank or coke oven battery, and which is characterized in that this aperture possesses a cover which covers the air supply on the outer side, with it being possible to withdraw this cover gradually so as to partially open the aperture for the supply of air, thus enabling the admittance of air, and the number of stages for withdrawal of the cover and for opening the air supply ranging between two and an infinite number, and the cover is connected to a rod which can be moved in vertical direction by means of a mechanical device such that the cover opens or closes the air supply by the vertical movement.

In the most frequently applied layout, the air supply or air supplies themselves are configured as tubes so that the inventive device sits like a lid on the tube, thus shutting the tube off. The tubes can be conducted both simply perpendicularly through the top ceiling or be configured as U tubes which terminate with their open end downwardly. In this case, the inventive cutoff device is seated horizontally mirrored with the collar-shaped bulge positioned in upward direction. The air supply devices may also have a rectangular cross-section and be conducted perpendicularly or obliquely through the top ceiling.

The channels may also be fabricated from brickwork, then forming an entry port in the coke oven top. The air entry port may also have an upwardly directed projection made of brickwork. On the inner side of the coke oven chamber top ceiling, the air feeding devices may have any arbitrary configuration and they may also be comprised of inserts to direct the introduced primary air. The channels or tubes for air supply may be provided with a sealing material in the top ceiling.

The inventive device for dosed proportioning and cutoff itself may also have any arbitrary shape. The inventive device serving as cover may be shaped like a disk which is comprised of a collar-shaped cover directed towards the coke oven chamber so that the cover has a cross-section that has the shape of an inverted cup, with it being required for it to have a cross-section larger than the air feeder to be covered in order to be able to realize the inventive function. The cup may have any arbitrary shape. The cup may have the central interface of a straight line with two straight lines branching off at an angle of 60°. However, the cup may also have the shape of a swung "W", i.e. a "W of rotation", with the cups being used in inverted form.

However, the inventive device may also be configured as an inverted hollow downwardly open cone, with the hollow cone and the central interface having the shape of an inverted "V". At the point of the largest cross-section, the inverted hollow cone is larger in cross-section than the air feeder to be covered. The "V", too, may have a swung shape or, in other words, a shape not ending in an acute tip. The hollow cone may have any arbitrary shape as long as it fulfills its task of covering.

In a very simple embodiment, the device for covering and dosed proportioning may be configured as a simple flap which is not fastened to the air feeder device. The device can be raised or lowered by means of a rod with a movement mechanism.

Finally, the cover may also have the shape of a massive cone which is moved into the air-feeding device so that the air-feeding device or the tube is shut as the cone is moved-in. The massive cone may also be configured as a hollow cone, though closed towards all sides. It also fulfills the covering function as it is moved with the tip into the air-feeding device, thus shutting it off, and is likely to be less costly in production. The covering inventive device may also have the shape of a simple plate as long as it fulfills its covering function. Finally, the covering inventive device may also have any arbitrary shape as long as it fulfills its inventive task.

The inventive device may be fabricated from any arbitrary material that sufficiently withstands high temperatures prevailing at the coke oven chamber top. This may be stainless steel, for example, but it may also be made of ceramics or stone. The inventive insert can also be equipped with seals or barricading devices.

On its inner side, the inventive device may have thickenings that can be moved into the air supply device, thus providing for an additional tight shutoff. These are preferably made of refractory material. This is helpful, especially during the start-up phase. These thickenings can be raised or lowered with bolting devices towards the inventive device for covering and dosed proportioning.

The inventive device is moved away from the air supply so that it opens the air-feeding device. If the air-feeding device is an inverted cup, it is moved away from the air-feeding device by raising it. In its closed position, it simply rests on the tube so that it is shut. In an exemplary embodiment, the cup is downwardly connected to a rod so that it is linked to a hydraulic lifting cylinder. This hydraulic lifting device raises or lowers the inverted cup so that it shuts the tube when lowered. The device can be lowered or raised in two stages ("open"-"closed") or in any arbitrary number of stages.

The device for opening or closing can also exercise the desired function when swung away laterally. This is accomplished through an articulated joint device which is fastened to the covering device. It can swing away in any arbitrary direction. The swinging procedure, too, can be accomplished in a number of stages ranging from two to infinite, ("stepless").

If the covering device is a massive cone, it is generally moved only by raising or lowering, because in general it is impossible to swing it away. In principle, however, any device is conceivable that moves the covering device to and from the air-feeding device.

As a rule, the cover is larger in cross-section than the air-feeding device or than the tube in order to be able to ensure a complete covering. Even an incompletely covering device is conceivable, but is implemented only rarely. Typically the largest cross-sections for an inventive cover range from 80 to 280 millimeters. Typically the largest cross-sections for air supplies or tubes equipped with the inventive cover range from 50 to 250 millimeters. In a typical embodiment, the tubes are 50 to 1200 mm high.

On its inside, the air supply may be provided with air-conducting devices. On its inside, the inventive device may for example be provided with a bottleneck that exerts a Venturi effect on the gas streaming in. Thereby, the velocity of the air flow streaming-in is increased. The air supply can also be provided with baffle plates. On the inside of the coke oven chamber, the air supply may also be provided with gas-conducting devices or spouts. If the covering device is a plate or a cup, then it can be provided with an aperture or a sight glass that allow for taking insight or getting access to the areas situated under the cover.

In most applications, the air feeders are so arranged that they are mounted individually and in a multitude on the top of coke oven chambers. However, it is also possible to utilize collective pipes which centrally aspirate air and distribute it to the individual air feeders. An example for a collective pipe serving for discharge of gas from several coking chambers equipped with gas-discharging pipes is disclosed in GB 384092. Flaps (18) serving as proportioning device are provided within the individual gas-discharging pipes. A proportioning device mounted from the outside and having a covering effect is not disclosed therein. As proposed in the present invention, a collective pipe which supplies primary combustion air from the outside and distributes it into the individual air feeder pipes of the primary combustion space(s) of a coke oven battery or coke oven bank can therefore also be provided with an inventive device for cutoff or dosed proportioning on the outer end of the collective pipe averted from the coke oven chamber.

The inventive device is easy to mount, it is a low-cost device and easy to maintain and/or easy to clean from contamination.

Claim is also laid especially to a method by way of which the air admittance into the primary heating chamber can be controlled and regulated with an inventive device. Claim is particularly laid to a method for dosed proportioning or cutoff of primary combustion air into the primary heating space of horizontal coke oven chambers, wherein primary combustion air is admitted through aperture(s) in the top ceiling of a coke oven chamber into the primary heating space of a coke oven chamber of a coke oven bank or coke oven battery, and this primary combustion air serves for partial combustion of the coking gas which streams on coal carbonization into the gas space situated above the coke cake and within the coke oven chamber, and the partially burnt coking gas thus obtained streams through appropriate channels into a secondary heating space situated beneath the coking chamber where the partially burnt coking gas is completely burnt with secondary combustion air, and which is characterized in that the apertures for admittance of primary combustion air are provided with a device arranged outside the coke oven chamber and accomplishing a dosed proportioning of primary combustion air or a cutoff of the admittance of primary combustion air into the coking space of a coke oven chamber, and the cover accomplishes dosed proportioning of the primary air by lifting vertically, and this device for dosed proportioning or cutoff of primary combustion air in the primary combustion space of a coke oven chamber by vertical lifting is utilized.

To execute the inventive method it is possible to arrange the device for dosed proportioning and cutoff on only one air feeder of one or several coke oven chamber(s) of a coke oven battery or coke oven bank and to utilize it for controlling the admittance of air. It can be mounted at any arbitrary position, with it also being possible that there are further air admittance devices which are non-controlled. It is also possible for the inventive device to sit on several air feeders of one or several coke oven chamber(s) of a coke oven battery or coke oven bank and to be utilized for control and regulation of the air admittance. For example, all air feeders of a coke oven chamber can be provided with the inventive device for cutoff. These can in any case be controlled and regulated individually or simultaneously.

The actuation can be accomplished manually from a remote position by utilizing a lever, a rope tackle or a linkage. The drive of the inventive device can also be performed hydraulically or electrically. For example, this can be executed directly at the cover or from a remote position, for example via a lever. If a hydraulic or electrical device is applied, the method can also be automated, for example with a process control system. Sensors may also be utilized for this purpose which for example pick-up the temperature or oxygen content in the coke oven chamber or in the primary heating space. Sensors that pick-up the position of the inventive device can also be utilized. Finally, it is also possible to utilize the device if a slight and constant negativepositive pressure is generated by means of a blower or compressor in the air-feeding device.

The inventive device is easy to mount because it is attached from the outside onto the air feeder device and it is also easy to retrofit in existing installations. It requires little maintenance and it is easy to clean from contamination. By its type of arrangement, the demand for space needed by the device and the coke oven chamber equipped therewith is little. By applying the inventive device, the air admittance into a primary heating chamber is easy to control so that an evenly distributed air supply into the primary heating space and an accordingly improved quality of the coke thus obtained is achieved. The inventive device for covering and dosed proportioning can be operated by applying a method that is easy to automate and that can be controlled by measuring parameters in the coke oven chamber.

The design and layout of the inventive device is elucidated by way of twelve drawings, with the design and layout of the present invention not being restricted to these embodiments.

FIG. 1 describes an inventive device (1) for dosed proportioning and cutoff of an air feeder (2) into the primary heating space (3) of a coke oven chamber (4). To be seen of the coke oven chamber is its top ceiling (5) and part of the primary heating space (3). The actual inventive device for covering (1) is configured as an inverted cup (1*a*) which has a round, collar-shaped cover (1*b*) directed towards the coke oven chamber through which the air inflow current (6) is cut-off, because it rests on the air supply device (2). The barricading device is fastened on the inside with a rod (7). This in turn is linked to a hydraulic cylinder (8) which is moved up and down by way of an appropriate hydraulic device. The hydraulic device is moved by the motor-driven actuator (8*a*) which is connected via connecting cables (8*b*) to a control unit (8*c*).

Figure 2:
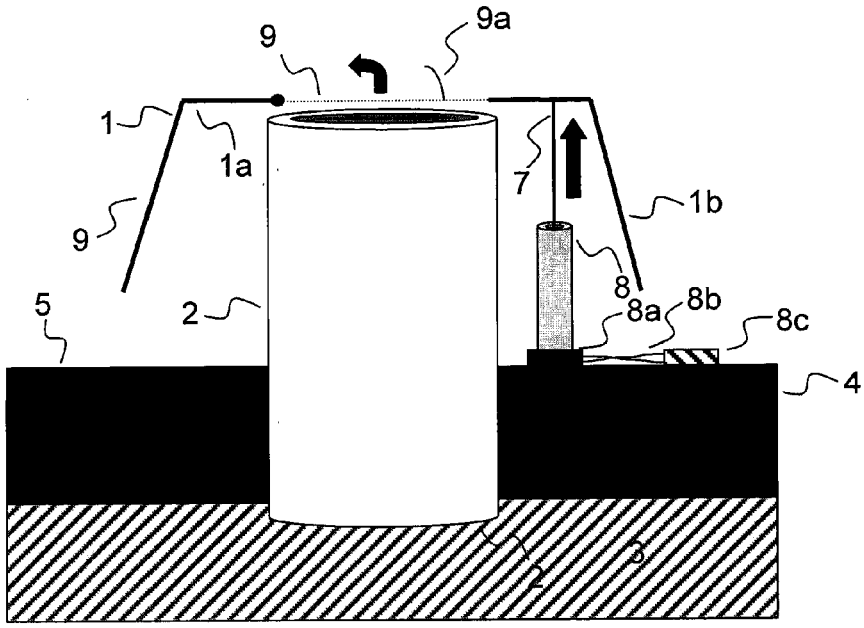
FIG. 2 illustrates one embodiment of the use of the device of FIG. 1.
Figure 3:
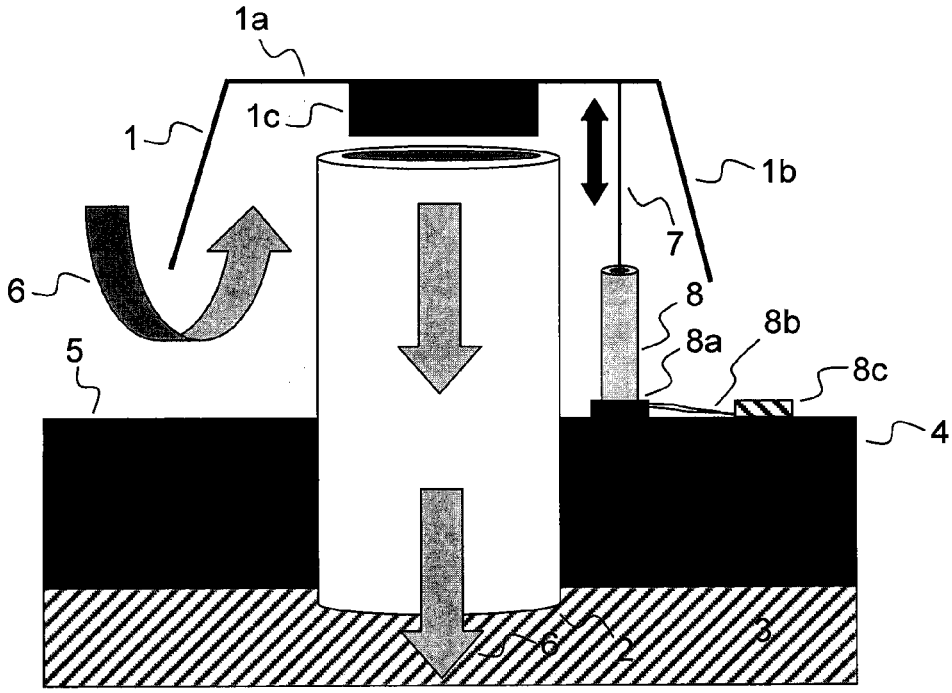
FIG. 3 illustrates a modification of the device of FIG. 1.
Figure 4:
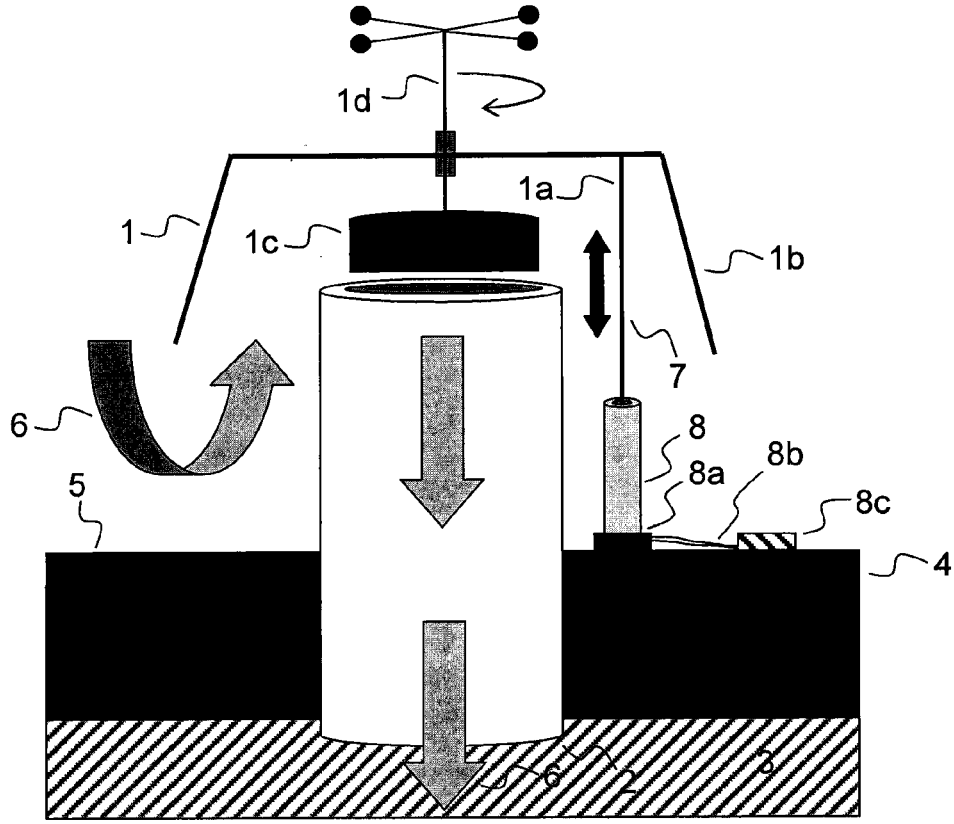
FIG. 4 illustrates an adjustable embodiment of a device of FIG. 3.

FIG. 2 shows the same device that has been opened by a hydraulic cylinder (8*a*). The hydraulic cylinder (8) moves the rod (7) upwards which also moves the cup (1*a*) upwards. Thereby, the air feeder for supply of primary air (6) is opened. Here, the device (1) is comprised of an inspection port (9), which represents a cover over an aperture or a sight glass with a handle (9*a*) suitable for inspecting the interior. FIG. 3 also shows the same device (1) which instead of the inspection port comprises a thickening (1*c*) arranged in the interior of the inverted cup (1*a*) and movable into the air feeder device (2), thus closing it tightly. This device, too, can be automatically moved by a rod (7) with a hydraulic cylinder (8). FIG. 4 also shows the same device (1) which comprises a thickening (1*c*) arranged in the interior of the inverted cup (1*a*) that can be sunk by way of a bolting device (1*d*), i.e. separately from the inventive flap (1), into the air feeder device (2). This device (2), too, can be automatically moved by a rod (6) with a hydraulic cylinder (7).

Figure 5:
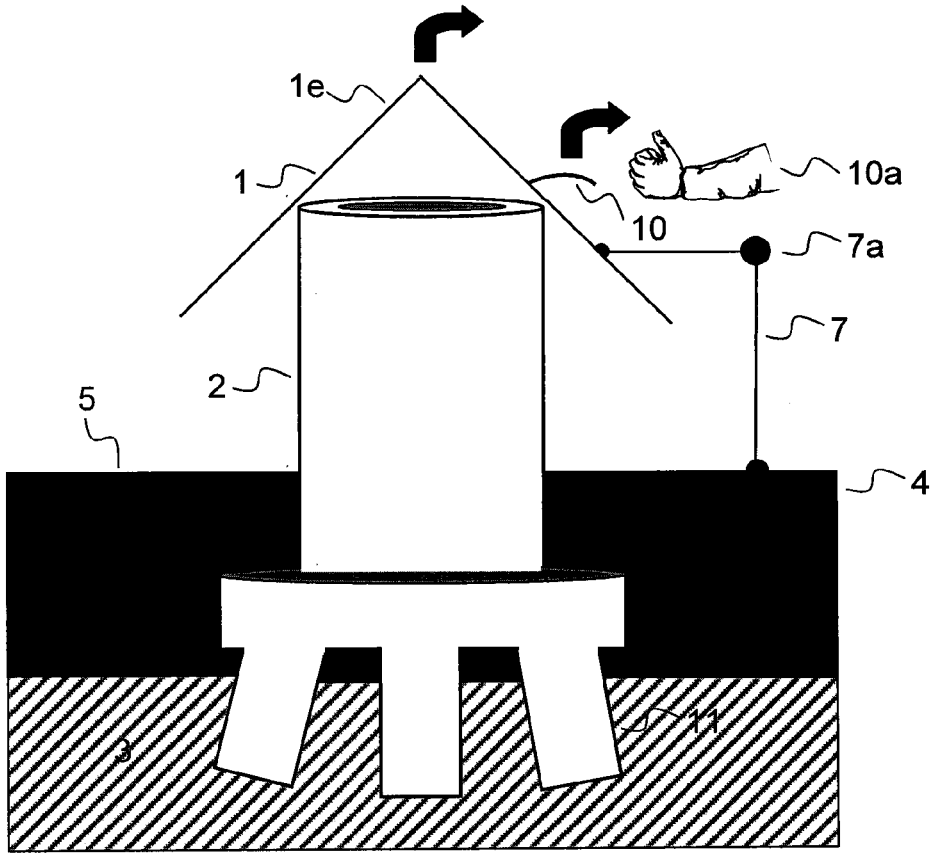
FIG. 5 illustrates a further embodiment of a primary combustion air supply dosed proportioning and cutoff device of the invention.
Figure 6:
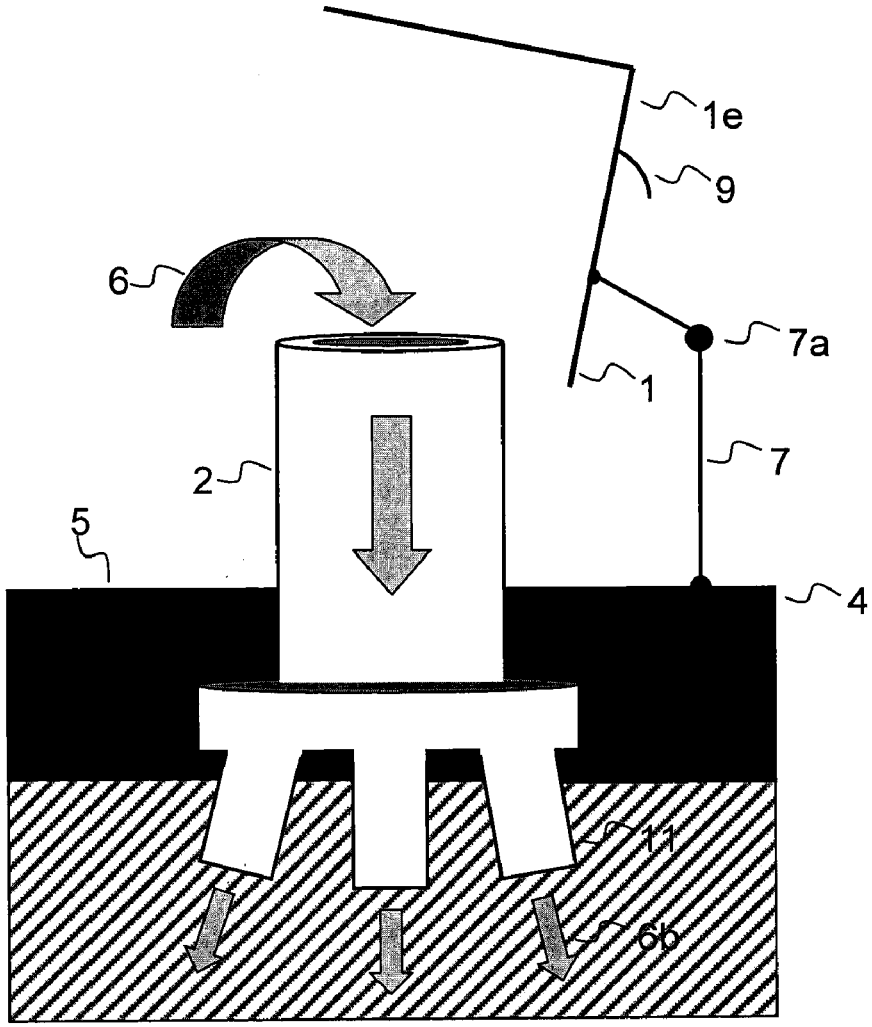
FIG. 6 illustrates one embodiment of the use of the device of FIG. 5.

FIG. 5 also describes an inventive device (1) for dosed proportioning and cutoff of an air feeder device (2) into the primary heating space (3) of a coke oven chamber (4). The shutting device is configured as a hollow inverted cone (1*e*) which is open towards the bottom. The hollow cone carries a handle (10) by means of which the entire hollow cone (1*e*) can be swung away manually (10*a*) towards the side. The hollow cone itself is fastened via a rod with articulated joints (7*a*). On the side of the top (5) directed inwardly into the coke oven chamber, the air feeder device (2) is provided with spouts (11). FIG. 6 shows the device (1) with the hollow cone (1*e*) in opened position. Primary air (6*b*) is introduced in a well directed form through the spouts (11).

Figure 7:
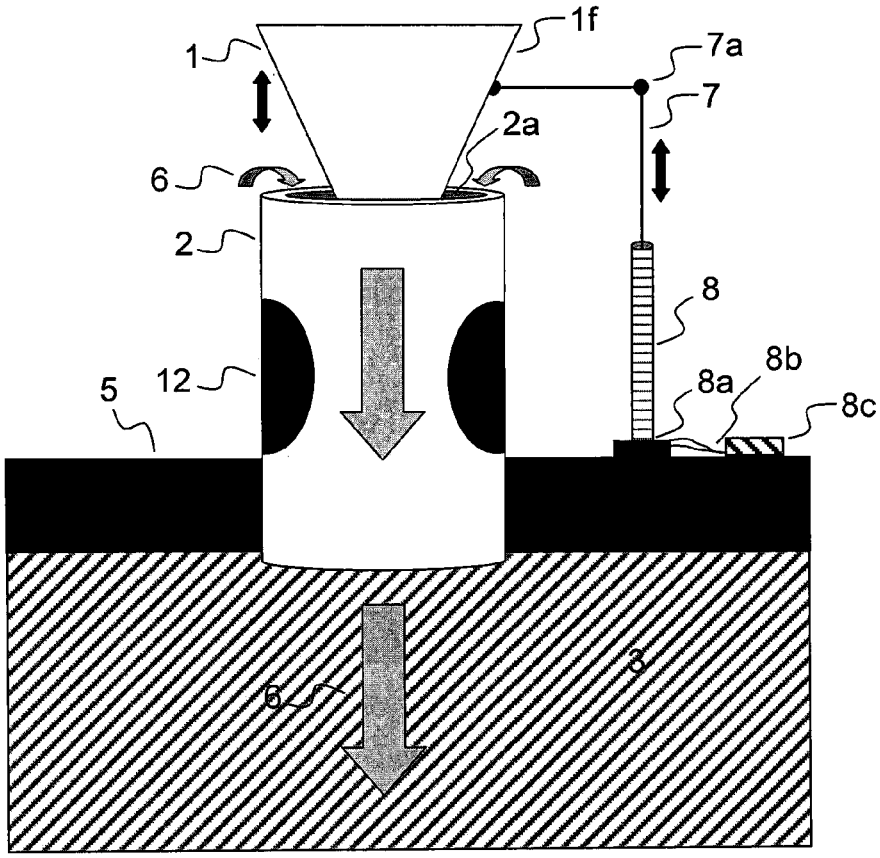
FIG. 7 illustrates a further embodiment of a primary combustion air supply dosed proportioning and cutoff device of the invention.
Figure 8:
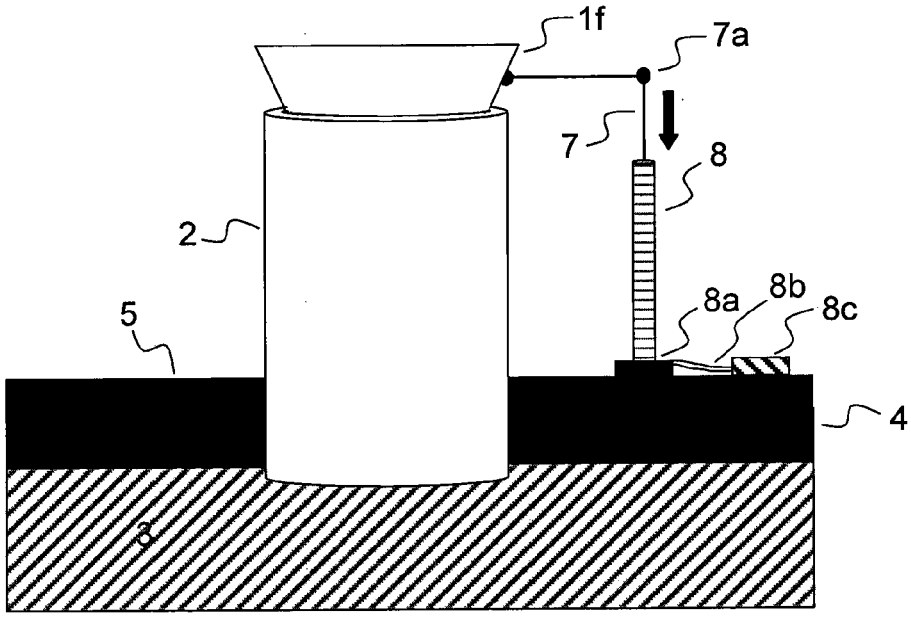
FIG. 8 illustrates one embodiment of the use of the device of FIG. 7.

FIG. 7 also describes an inventive device (1) for dosed proportioning and cutoff of an air feeder device (2) into the primary heating space (3) of a coke oven chamber (4). The device (1) is comprised of a massive closed cone (1*f*) which is moved into the aperture (2*a*) of the air-feeder device (2), thus closing it tightly. The air-feeder device (2) is comprised of bottlenecks (12) or equipped with a compressor (12) to increase the gas velocity (12) for primary air (6) streaming in. FIG. 8 shows this device (1*f*) in closed position. The movement is caused by a hydraulic cylinder (8) which is operated via a hydraulic actuator device. This in turn is controlled via a motor-driven actuator (8*a*) connected via connecting cables (8*b*) to a control unit (8*c*). To be seen beneath the coke oven chamber top (5) is the primary heating space (3).

Figure 9:
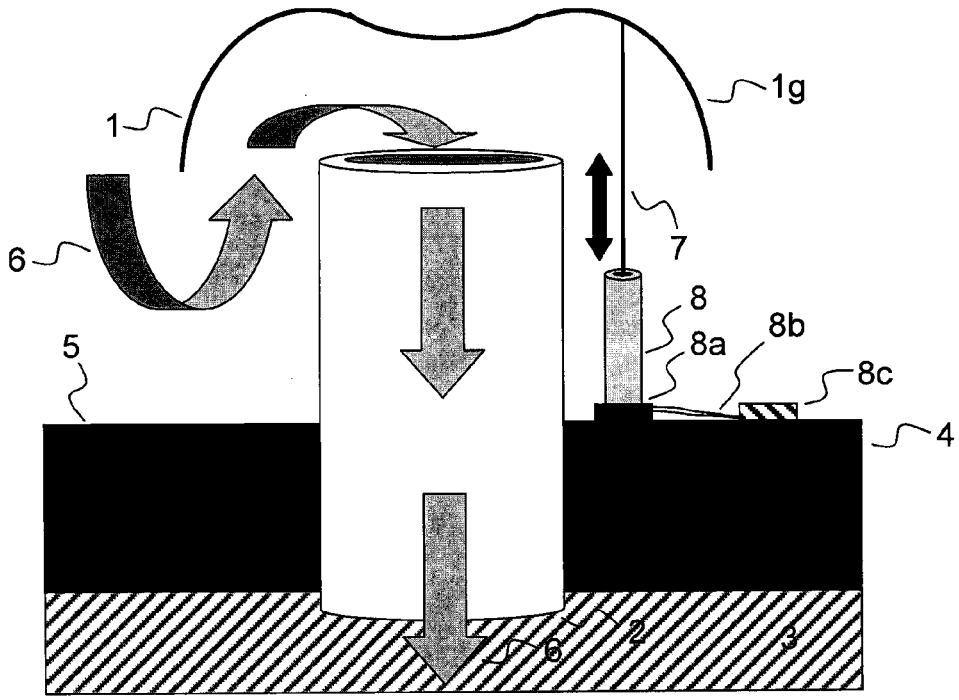
FIG. 9 illustrates a further embodiment of a primary combustion air supply dosed proportioning and cutoff device of the invention.

FIG. 9 describes an inventive device (1) for dosed proportioning and cutoff of an air feeder device (2) into the primary heating space (3) of a coke oven chamber (4). In this drawing, one can only see the cover on the air feeder device (2). In the central cross-section, it is shaped as a swung "W" (1*g*). Thereby, it can better cover the tube serving as air-feeding device (2).

Figure 10:
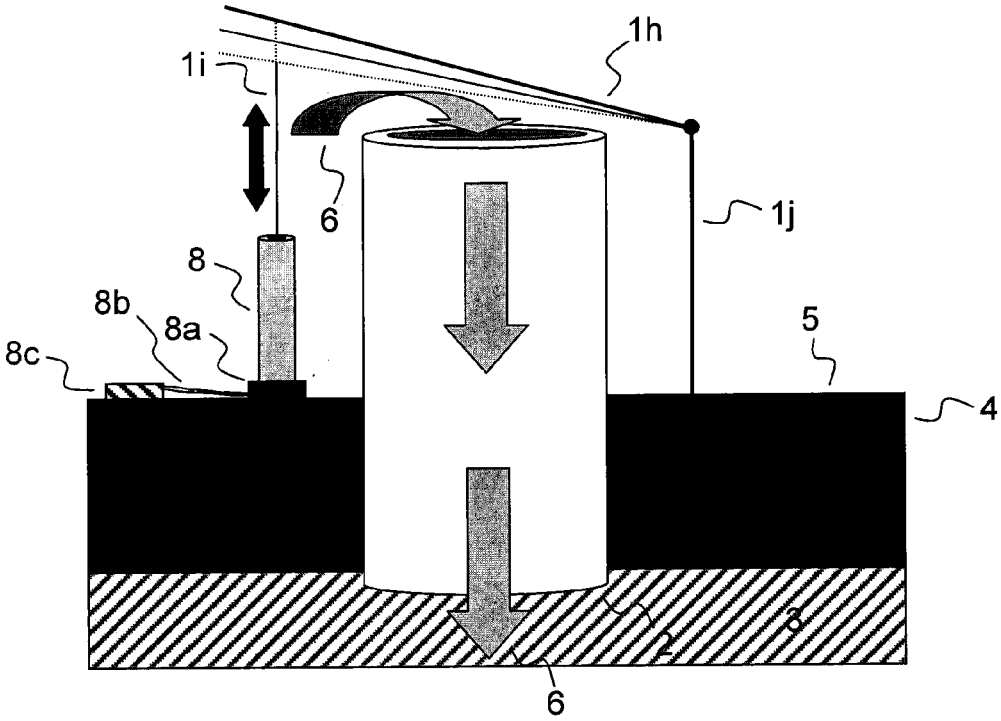
FIG. 10 illustrates a further embodiment of a primary combustion air supply dosed proportioning and cutoff device of the invention.

FIG. 10 describes an inventive device (1) which is configured as a simple flap (1*h*) an that it covers the air supply by unfolding it downwardly (1*i*) Downward unfolding is controlled by a lever (7) which is moved by a hydraulic cylinder (8). It is moved by a motor-driven actuator (8*a*). The flap is movably suspended to a bearing rod (1*j*).

Figure 11:
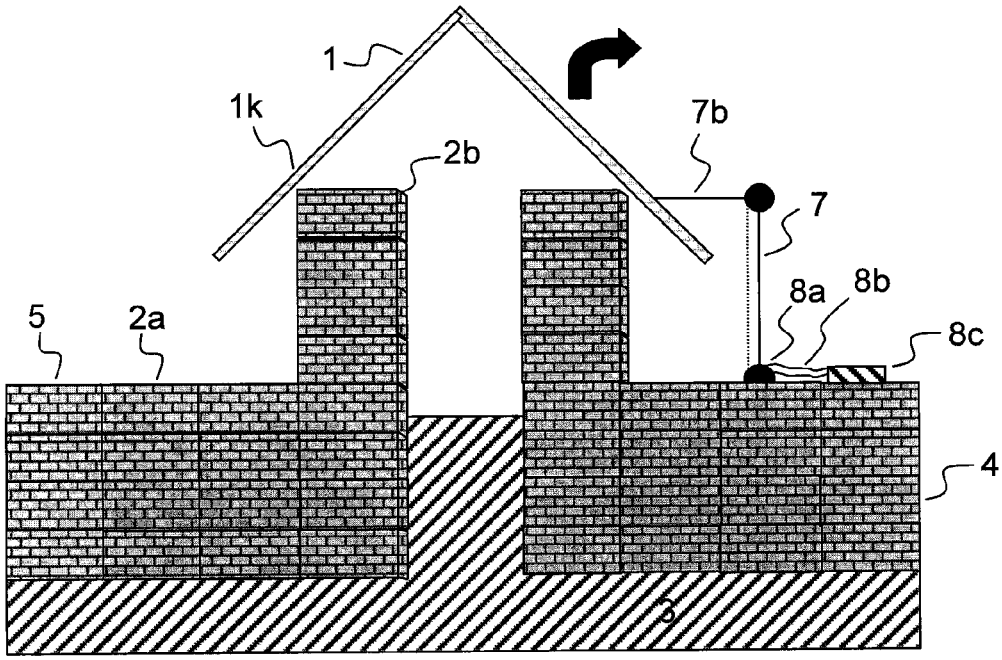
FIG. 11 illustrates a further embodiment of a primary combustion air supply dosed proportioning and cutoff device of the invention.

FIG. 11 describes an inventive device (1) which covers an air feeder device (2) supplying air into a coke oven chamber (4), with both devices being fabricated of mineral or stone-like material. The inventive device for covering and dosed proportioning (1) is configured as an inverted cone (1*k*) which is made of a ceramic material. The device for air feed (2) into a coke oven chamber (4) is fabricated from masonry bricks (2*a*) which form a bricked air supply channel (2*b*) formed as a projection. The device for dosed proportioning and covering (1) is opened by unfolding it laterally away.

Figure 12:
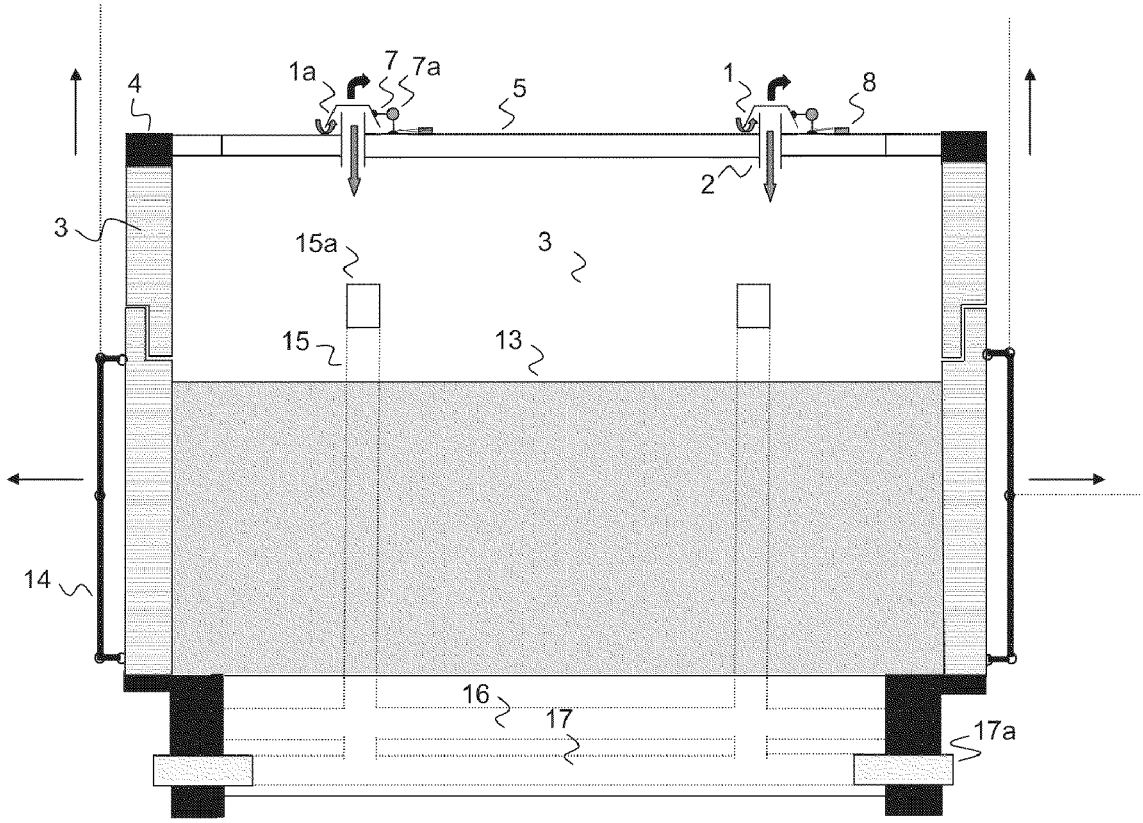
FIG. 12 and FIG. 13 illustrate the positioning and use of the inventive dosing and shutoff desires in a horizontal coke oven chamber.

FIG. 12 finally shows the arrangement of the inventive device (1) in a horizontal coke oven chamber (4) of the "Non-Recovery" or "Heat-Recovery" type. The inventive device for dosed proportioning and cutoff (1) is configured as a lid with a round, collar-shaped sleeve (1*b*) which is arranged above the air feeder device (2) which is configured here as a tube. It can be swung away laterally by means of an articulated joint device (7*a*), thus opening or closing the air supply (2). To be seen here are the coke cake (13), the coke oven chamber doors (14), the "downcomer" channels (15) including apertures (15*a*), the secondary heating space (16) and the secondary air sole (17). The secondary air sole (17) contains apertures (17*a*) which are also equipped with devices for dosed proportioning and cutoff that control and regulate the secondary air stream.

Figure 13:
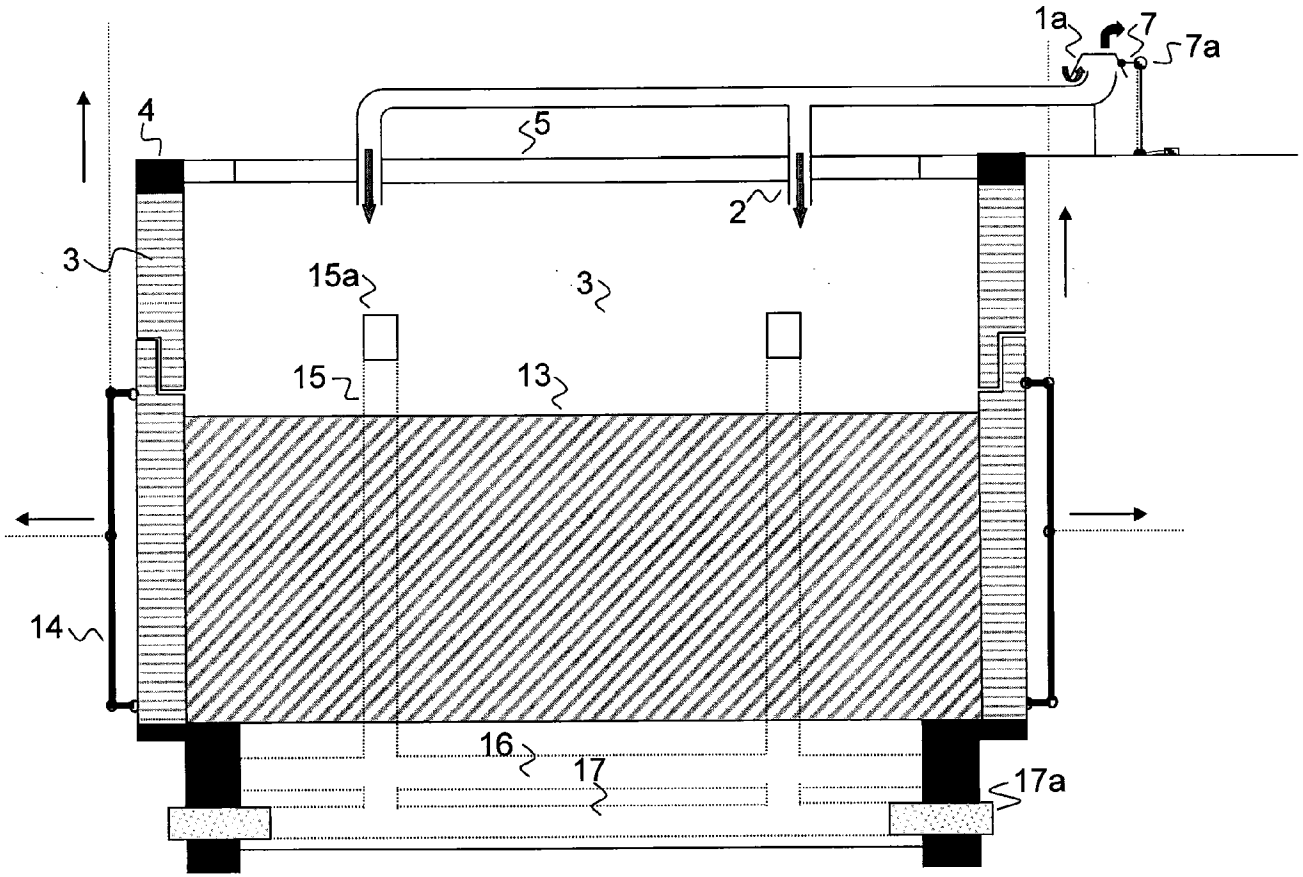

FIG. 13 shows the arrangement of the inventive device (1) for dosed proportioning and cutoff, wherein the air feeder tubes (2) in the primary heating space (3) are connected to a collective tube that feeds primary combustion air from the outside and distributes it into the individual air feeder tubes (2) of the primary heating space(s) (3) of a coke oven battery or coke oven bank, the cover (1*a*) being arranged on an outer end of the collective tube averted from the coke oven chamber (4).

LIST OF REFERENCE SYMBOLS

1 Device for dosed proportioning and cutoff
1*a* Inverted cup
1*b* Round, collar-shaped cover
1*c* Thickening
1*d* Bolting device
1*e* Hollow cone
1*f* Massive, closed cone
1*g* Inverted cup as a swung "W"
1*h* Flap
1*i* Flap positions of downward unfolding
1*j* Bearing rod
1*k* Inverted-over hollow cone made of masonry bricks
2 Air feeder device
2*a* Masonry bricks of the air feeder device
2*b* Air-feeding channel bricked-up as a projection
3 Primary heating space
4 Coke oven chamber
5 Top of the coke oven chamber
6 Air stream
7 Rod
7*a* Articulated joints for moving the rod
8 Hydraulic cylinder
8*a* Positioning motor
8*b* Connecting cable
8*c* Control unit
9 Inspection port as a cover over an aperture or sight glass including handle
10 Grip for opening
10*a* Manual opening:
11 Spouts

12 Bottlenecks to increase gas flow velocity, "Venturi" effect, or compressor
13 Coke cake
14 Coke oven chamber doors (with opening device)
15 "Downcomer" channels
15*a* Apertures of "downcomer" channels
16 Secondary heating space
17 Secondary air sole
17*a* Device for dosed proportioning and cutoff of secondary air sole aperture

The invention claimed is:

1. A coke oven in a coke oven bank or coke oven battery comprising at least one aperture and a cover for the aperture for controlling admittance, dosed proportioning and cutoff of a primary combustion air supply fed into a primary heating space of a horizontal coke oven chamber, said aperture(s) communicating with the primary heating space of the horizontal coke oven chamber from an outer side, wherein:

at least one aperture for supply of primary combustion air is arranged in a top ceiling of at least one coke oven chamber of the coke oven bank or coke oven battery;

the at least one aperture is associated with a cover which covers the aperture on the outer side;

the cover connected to a rod which is moveable in a vertical direction by means of a mechanical device such that the cover increases or reduces the air supply by a vertical movement of the cover.

2. The coke oven of claim 1, wherein the apertures are configured as vertical tubes leading through the top ceiling of the coke oven to supply primary air to the primary heating space.

3. The coke oven of claim 1, wherein the cover is configured as a disk having a round, collar-shaped cover directed towards the coke oven chamber so that it has a cross-section having the shape of an inverted cup, this cover being larger in cross-section than the aperture to be covered.

4. The coke oven of claim 1, wherein the cover is configured as a hollow downwardly open cone which at the position of the largest cross-section is greater in cross-section than the aperture to be covered.

5. The coke oven of claim 1, wherein the cover has a plug on the side facing the aperture and the coke oven chamber, said plug moveable into the aperture during a downward vertical movement of the cover, thus closing the aperture.

6. The coke oven of claim 5, wherein the plug is fabricated of a refractory material.

7. The coke oven of claim 5, wherein the plug can be raised or lowered relative to the cover by means of a bolting device.

8. The coke oven of claim 1, wherein the cover is configured as a cone having a tip and can be moved with its tip into the aperture, thus covering the aperture.

9. The coke oven of claim 1, wherein the aperture is a tube having a cross-section of 50 to 250 millimeters at the position of the largest cross-section, and the cover has a cross-section of 80 to 280 millimeters at the position of the largest cross-section, the cover cross-section being larger than the aperture cross-section.

10. The coke oven of claim 1, wherein the aperture is a tube which in its interior comprises a bottleneck that exerts a Venturi effect, increasing the air flow velocity of air entering the aperture.

11. The coke oven of claim 1, wherein the cover further comprises an aperture or sight glass through which areas located beneath the cover are accessible and can be visually inspected.

12. The coke oven of claim 1, wherein air feeder tubes in the primary heating space are connected to a collective tube that feeds primary combustion air from the outside and distributes it into individual air feeder tubes of the primary combustion space(s) of a coke oven battery or coke oven bank, and the cover is arranged on an outer end of the collective tube averted from the coke oven chamber.

13. The coke oven of claim 1, wherein the at least one aperture comprises a hollow tube extending above the coke oven ceiling, and wherein the cover has a collar which, when in a closed position of the cover, extends beyond the end of the hollow tube, in the direction of air entering the tube.

14. A method for controlled admittance and dosed proportioning or cutoff of primary combustion air fed into a primary heating space of one or more horizontal coke oven chambers of claim 1, comprising:

admitting primary combustion air through aperture(s) in the top ceiling of at least one coke oven chamber into the primary heating space of the coke oven chamber of a coke oven bank or coke oven battery, and partially burning coking gas generated by coal carbonization by primary combustion air in a gas space situated above a coke cake and within the coke oven chamber to obtain partially burnt coking gas, and conducting the partially burnt coking gas through channels into a secondary heating space situated beneath the coking chamber where the partially burnt coking gas is further burnt with secondary combustion air, and regulating combustion by controlling the amount of primary combustion air admitted into the primary heating space by the apertures for admittance of primary combustion air by the cover positioned outside the coke oven chamber and controlling a dosed proportioning of primary combustion air or a cutoff of primary combustion air into the primary heating space of the coke oven chamber by lifting or lowering the cover vertically.

15. The method of claim 14, wherein the cover covers only one aperture of one or several coke oven chambers of a coke oven battery or coke oven bank and is utilized for controlling the admittance of air.

16. The method of claim 14, wherein covers cover each of a plurality of apertures of one or several coke oven chamber (s) of a coke oven battery or coke oven bank.

17. The method of claim 14, wherein the covers are actuated manually via a lever, a linkage or a rope tackle.

18. The method of claim 14, wherein the covers are actuated hydraulically.

19. The method of claim 14, wherein the covers are actuated by an electric motor.

20. The method of claim 14, wherein the supply of primary combustion air is augmented via a blower or compressor operating at a slight positive pressure.

* * * * *